United States Patent [19]

Gerard

[11] 4,194,142

[45] Mar. 18, 1980

[54] MODE CONTROL APPARATUS FOR A SEPARABLE-INSERT COAXIAL MAGNETRON

[75] Inventor: William A. Gerard, Andover, Mass.

[73] Assignee: The United States of America as represented by the Secretary of the Navy, Washington, D.C.

[21] Appl. No.: 924,280

[22] Filed: Jul. 10, 1978

[51] Int. Cl.[2] ..... H01J 25/50

[52] U.S. Cl. ..... 315/39.77; 315/39.51; 331/91

[58] Field of Search ..... 315/39.77, 39.51; 331/39

[56] References Cited

U.S. PATENT DOCUMENTS

| | | | |
|---|---|---|---|
| 3,169,211 | 2/1965 | Drexler et al. | 315/39.77 |
| 3,479,556 | 11/1969 | Cook | 315/39.77 X |
| 3,582,707 | 6/1971 | Hynes | 315/39.77 |
| 3,882,352 | 5/1975 | Osepchuk et al. | 315/39.77 |
| 4,053,850 | 10/1977 | Farney et al. | 315/39.77 |

*Primary Examiner*—Saxfield Chatmon, Jr.

*Attorney, Agent, or Firm*—Richard S. Sciascia; Paul N. Critchlow

[57] ABSTRACT

A standard demountable coaxial magnetron has a cathode and a surrounding anode shell formed with slots through which electromagnetic energy is coupled into an external resonant stabilizing cavity. The anode and its associated components are contained in a vacuum-sealed interaction cavity envelope separably mounted in the sleeve-like body of the stabilizing cavity. A ceramic window sealably covers the slots and has its axial ends coupled to the axial ends of the anode shell by kovar strips. Since various unwanted modes of oscillation, such as the $TE_{121}$ mode, occur in the external resonant cavity, standard mode-suppression $TE_{121}$ chokes are used. Such a choke includes a high rf loss absorber carried in a choke cavity formed between the cavity and the anode. However, the kovar strips also extend through this choke cavity and, in many cases, seriously interfere with mode suppression. A knitted gasket placed near the choke cavity entrance between the kovar strip and the anode shorts the kovar to effectively reduce its impedance and permit excitation of the absorber. The knitted structure provides a needed flexibility.

6 Claims, 6 Drawing Figures

MODE CONTROL APPARATUS FOR A SEPARABLE-INSERT COAXIAL MAGNETRON

BACKGROUND OF THE INVENTION

The present invention relates to the suppression of unwanted modes of oscillation present in the resonant cavity of separable-insert coaxial magnetrons.

As has been indicated, during the development of standard separable-insert coaxial magnetrons, one of the major problems has been the difficulty of obtaining a low $TE_{121}Q$. Unwanted modes of oscillation, such as the $TE_{121}$, present in the external resonant of 'stabilizing' cavity were not being effectively removed or suppressed. For example, although the VMS-1009 magnetron, developed by Varian Associates, Inc. and now known as the VMS-1104, employed a standard step choke for $TE_{121}$ suppression, little or no energy is coupled into its absorber.

The present invention fundamentally provides an optimum arrangement for effectively resolving this particular difficulty. This arrangement, although primarily applicable to the standard $TE_{121}$ chokes and to particular magnetron designs, also is capable of suppressing other unwanted resonant cavity modes and it also can be adapted for use in other magnetrons.

According to the present invention, a flexible metal gasket is placed directly next to the ceramic shell to short the impedance of the kovar sealing strip and permit excitation of the standard choke arrangement. The use and placement of this gasket relative to other structural components is predicated upon a thorough analytical study of the prior art difficulties and a resulting appreciation of the basic cause of the problem.

BRIEF DESCRIPTION OF THE DRAWINGS

The invention is illustrated in the accompanying drawings of which.

DETAILED DESCRIPTION

Figure 1:
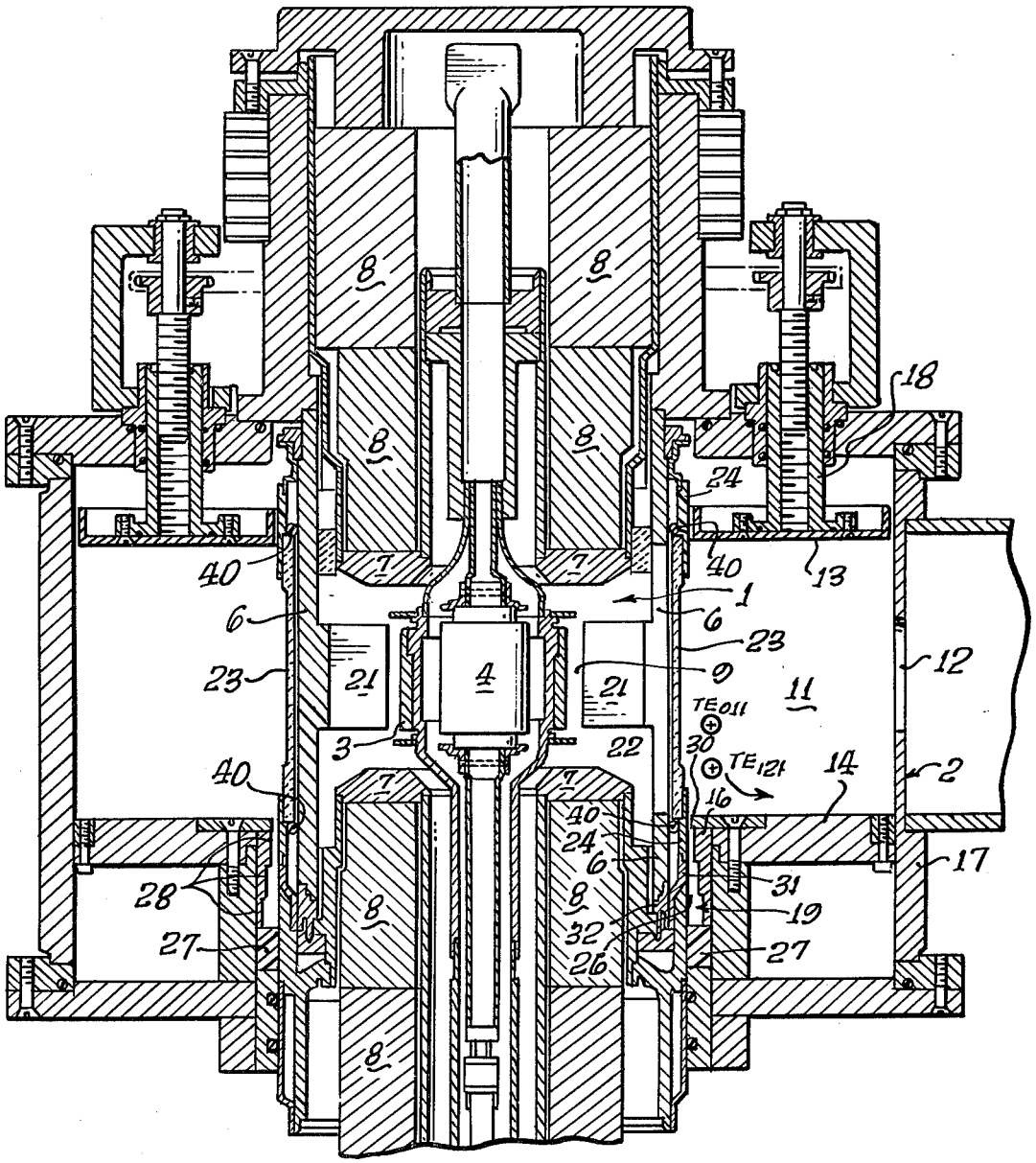
FIG. 1 is a section through the central axis of a coaxial external cavity magnetron embodying the present invention.

FIG. 1 is a standard coaxial, separable-insert magnetron often referred to as a 'sleeve' or an external cavity magnetron. As is known, the structural arrangement of these magnetrons is characterized by the use of a vacuum-sealed envelope 1 separably mounted in an external cavity sleeve or body 2. Conventional electron-interaction elements, such as cathode 3, heater 4, anode 6 and pole-pieces 7 are contained in sealed envelope 1 which for descriptive purposes can be considered as defining an interaction cavity 9 generating low Q microwave energy. Permanent magnets 8 also are employed. An external cavity 11 formed by body 2 is a resonant high Q stabilizing cavity into which the generated energy is coupled. This cavity, in turn, is coupled to an output wave guide or the like (not shown) through an iris 12. An advantage of using such a sealed and separable envelope is that resonant cavity 11 need not be evacuated.

Consequently, its structural components need not be limited by high vacuum considerations and can be formed of light-weight materials such as aluminum.

As may be noted in FIG. 1, resonant cavity 11 is formed with radially-extending end walls 13 and 14 at its axial ends and with axially extending side walls 16 and 17. End wall 13 is in the form of a conventional axially-adjustable tuning plunger 18 used for changing the resonant frequency of high Q cavity 11. Thus, cavity 11, for purposes of identification, can be considered as having a 'tuning' end, i.e. the axial end containing plunger 18, and a 'fixed' end, i.e. the end formed by wall 14.

A choke arrangement generally identified by numeral 19 and known in the art as a $TE_{121}$ choke is provided in the so-called 'fixed' end. The detailed configuration of this choke arrangement will be described subsequently. For the present, it is noted that the term $TE_{121}$ is a conventional one used to categorize a transverse electric mode of oscillation having a generally radial component of electric field indicated by the arrow in FIG. 1. $TE_{011}$ refers to the circular or circumferential mode (CEM) circulating around the cavity. Modes having radial or axial components, such as $TE_{121}$, are unwanted and their Q should be reduced to an acceptable value. Conversely, it is desired to increase the Q of the $TE_{011}$. In actual practice, a magnetron configuration such as the one that has been described, primarily is concerned with $TE_{121}$ mode suppression and the standard choke is specially designed for this purpose. However, the invention is not intended to be so limited.

With regard to the interaction cavity components, cathode 3 is a cylindrical emitter surrounding radiant heater 4. Emitter and heater leads extend axially through a support structure and through an appropriate seal to an external power supply. Emitted electrons are drawn from the cathode to anode 6 which is a copper, shell-like structure having a conventional circular array of vanes 21 which, as will be understood, are regularly spaced circumferentially to define cavities between adjacent vanes which are resonant at approximately the desired frequency of oscillation. Coupling slots 22 are provided between the vanes to couple the low Q generated energy of the interaction cavity into high Q external cavity 11.

Since the space within envelope 1 is vacuum sealed, slots 22 must be sealably covered. For this purpose, a dielectric shell-like window 23, preferably formed of a ceramic, covers the slots and has both of its axial ends sealably secured to anode 6 by kovar sealing strips 24. Other vacuum seals obviously must be provided for other portions of the envelope such as the magnets and, of course, suitable sealing arrangements are needed at the axial ends of the envelope. However, except for kovar sealing strips 24, the sealing details are not presently pertinent and can be provided in any suitable manner. Also, other components of the illustrated magnetron which have not been specifically identified should be readily recognized and their functions understood. If further structural detail is desired, there is a rather comprehensive description of a comparable magnetron provided in U.S. Pat. No. 4,053,850, Magnetron Slot Mode Absorber, issued Oct. 11, 1977, to Farney et al.

The present invention is concerned primarily with assuring the effective operation of $TE_{121}$ choke arrangement 19. As shown, it is formed with a choke cavity or gap 26 provided at the so-called 'fixed' end of resonant cavity 11 between its wall 16 and anode 6, the cavity having an opening or entrance 30 in direct communication with resonant cavity 11. A ring-shaped absorber member 27 is positioned in this cavity or gap to absorb unwanted modes of oscillation present in external cavity 11. For obvious reasons, absorber 27 is formed of a lossy material which, since it is outside of the vacuum envelope, can be provided by a conventional high rf loss material. In practice, a fired sugar-loaded alumina is used. Choke gap 26 preferably is empirically designed to match the unwanted cavity modes into the choke absorber. As shown, it is formed with $TE_{121}$ rings 28 that are stepped in the illustrated manner to provide a $TE_{121}$ impedance or match which subsequently will be described. A number of individual rings can be used or, if desired, a single piece. Principles for controlling the impedance match are known.

Oscillation modes $TE_{121}$ and $TE_{011}$ have been identified in previous discussions and as explained, optimum operation of the illustrated magnetron involves primarily suppression of $TE_{121}$. The removal of other closely-related radial or axial modes is within the present inventive scope. However, there is one distinction that should be noted. In particular, the unwanted modes of present concern are the so-called 'cavity' modes present in resonant cavity 9. As such, they can be distinguished from the so-called 'slot' modes with which, for example, the previously-mentioned U.S. Pat. No. 4,053,850 is directly concerned. 'Slot' modes, as is known, are a set of resonant modes associated directly with slots 22 of the anode shell and there is a comparable need for suppression which, as disclosed in the referenced patent, can be achieved by a lossy material absorber comparable to the present absorber. However, as will be recognized, the arrangement and the purpose of the 'slot' mode absorber is quite different from that of the present $TE_{121}$ choke which is intended to directly suppress the radial $TE_{121}$ modes coupled into choke cavity 26 through and across its entrance 30.

$TE_{121}$ choke cavity 26, in addition to its stepped ring arrangement and its lossy absorber 27, provides a space through which kovar strip 24 extends to sealably couple ceramic window 23 to the axial end of anode 6 and, also, to provide support for the window. Strip 24, as will be noted, is a relatively long member and, since it is metallic, it provides a path for current flow. It is, therefore, a member that presents considerable electric impedance to current flow. In particular, the term 'kovar' is a Westinghouse Electric Corporation Trademark for an iron-nickel-colbalt alloy having thermal expansion characteristics matching those of hard glass. It provides matched expansions between metals, such as the copper anode, and ceramics, such as window 23. In actual practice, however, it is preferred to use a convoluted length 31 of a copper-nickel alloy to couple an end of the kovar strip to the metal anode which, itself, is formed with a copper-nickel end piece 32. Such a cu-ni length is beneficial in obtaining a good brazed joint. Brazing of the kovar directly to the anode can cause problems since, under high stresses, such a brazed connection may crack. However, regardless of how the strip is secured, the significant factor, as already noted, is that its length is so extensive as to present an impedance which, as will be explained, can prevent excitation of the $TE_{121}$ choke.

The need for the relatively long strip arises because, as shown, the axial end of ceramic window 23 terminates at the entrance to $TE_{121}$ choke cavity 26, i.e. at or near its entrance opening 30. Such a configuration, in part, is dictated by design considerations in that, in magnetron design, it is important to use as little ceramic as possible and also to avoid extending the ceramic into the choke cavity where it becomes difficult if not impossible to control the electrical effects. Consequently, the design utilizes an axial length of ceramic limited essentially to the length of the anode slot so that it does not project into the choke to any significant degree. The anode, on the other hand, extends well beyond the axial length of the ceramic window into thermal exchange contact with adjacent heat-conducting members which functionally are anode extensions used to conduct heat from the anode.

Figure 2:
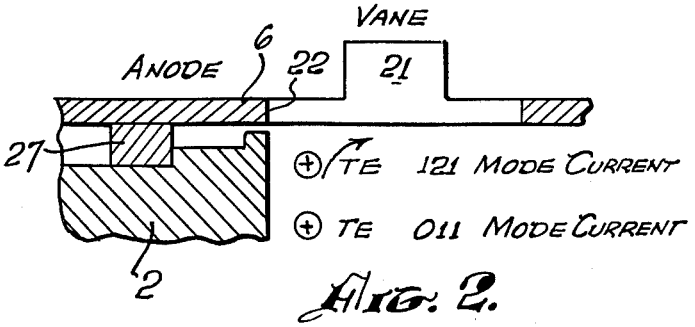
FIGS. 2 and 2*a* are schematic views illustrating respectively a standard $TE_{121}$ choke arrangement and its electrical operation.
Figure 2A:
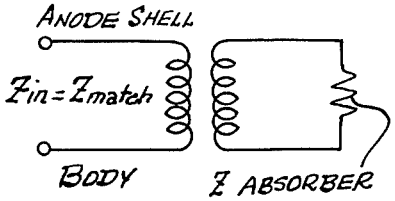
Figure 3:
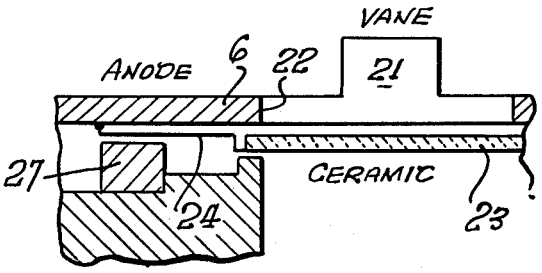
FIGS. 3 and 3*a* are schematics similar to FIGS. 2 and 2*a* showing the use and effect of a kovar sealing strip on the choke operation.
Figure 4:
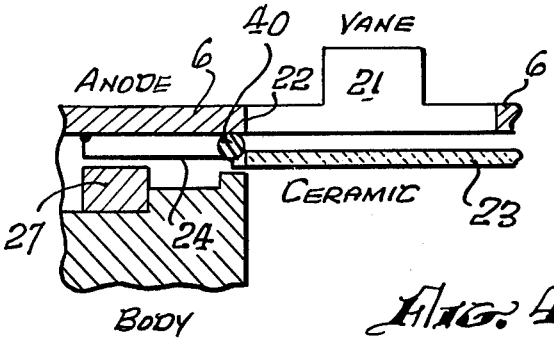
FIG. 4 is another schematic showing the use of the present knitted gasket.

FIGS. 2–4 are provided to illustrate the particular problem confronting conventional choke absorber arrangements such as have been described and also to demonstrate the manner in which the present invention solves the problem. FIG. 2 schematically shows simply the standard $TE_{121}$ choke formed next to the anode shell without the use of the ceramic window. Such an arrangement is used when there is no need to seal the anode slots or, in other words, when the present separable insert or external cavity magnetron design is not used. As indicated, the current components of the $TE_{121}$ mode extend radially of between body 2 and the anode, while the $TE_{011}$ has only circumferential current components. Since $TE_{121}$ is radial, it excites a voltage across the choke cavity or gap and, as already stated, the gap usually is specially formed with stepped Z rings or the like to match absorber to the $TE_{121}$ and reduce the Q to an acceptable value. This Z match is indicated in FIG. 2*a*. The $TE_{011}$, being circular, does not couple into the gap.

Figure 3A:
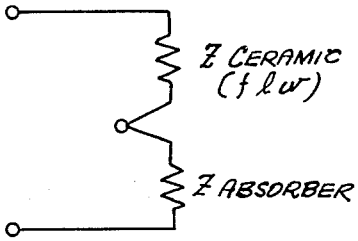

FIG. 3 illustrates the present external cavity magnetron with its ceramic window covering the anode slots. In this arrangement, the ceramic and its support kovar strip 24 form a parallel circuit to the choke groove which, as shown in FIG. 3*a*, is electrically in series with the $TE_{121}$ choke. As apparent in FIG. 3*a*, the impedance of the Z ceramic is a function of the electrical length (flw) between the weld or other solid connection and the end of the kovar that is sealed to the ceramic. If this distance were electrically short, the Z ceramic would be a near short circuit and would not interfere with the choke. On the other hand, if it is near $\lambda/4$, the Z ceramic will look like an open circuit and all of the $TE_{121}$ voltage will appear across it. In this event, no energy couples into the $TE_{121}$ choke. Increasing the weld length to $\lambda/2$ might be acceptable but it is mechanically undesirable due to interference with the magnetic and cooling portions of the design. The problem then is to assure that the energy is effectively coupled to the choke absorber regardless of the actual length of the kovar strip which, as has been noted, is substantial. This problem arises because, as shown in FIGS. 1 and 4, the mechanical construction also requires isolation or spacing between the ceramic and the anode since they are expansion mismatches.

The solution to the problem, as schematically shown in FIG. 4, is the use of a flexible, knitted metal gasket 40 next or in close proximity to the ceramic near entrance opening 30 of choke cavity 26. The gasket spans the gap between kovar strip 24 and the anode and, being conductive, places a short between these two members. The short, in turn, effectively reduces the Z ceramic to a low value and, in turn, allows excitation of the standard step choke for $TE_{121}$ suppression. Also, the knitted gasket, being flexible does not introduce destructive forces on the ceramic from the thermally expanding copper anode shell. If desired, such a gasket can be held in place by a suitable spacer (not shown) that floats in the kovar-shell spacing. The preferred practice, however, is simply to spot weld the gasket in the desired location. The spot welding is sufficiently stable to eliminate the need for any spacer.

The gasket itself is, as stated, a flexible, knitted component formed of a suitable conductive metal. A Technit braid has been successfully used in practice. Although the knitted gasket provides a simple manner of achieving the short, it will be apparent that other devices, such as small spring fingers, could be used. The critical requirement is the establishment of a short close to the end of the ceramic.

In previous discussion, the successful use of the gasket with the standard $TE_{121}$ choke has been noted. In particular, tests have been conducted on a Varian Associates Inc., VMS 1104 magnetron which is a coaxial, separable-insert design similar to that which has been described. In the tests, relative data was obtained for particular operating frequencies both with and without the use of the gasket. The following table shows the results obtained in these tests:

Test Data Table

| | $TE_{011}$ | | $TE_{121}$ | | |
|---|---|---|---|---|---|
| Gigahertz f | Q(No Gasket) | Q(gasket) | f | Q(No Gasket) | Q(gasket) |
| 3.5 | 3322 | 5240 | 3.55 | 526 | 201 |
| 3.6 | 2885 | 3585 | 3.65 | 511 | 124 |
| 3.7 | 2522 | 3388 | 3.75 | 458 | 109 |

As apparent in the test data, the Q of the $TE_{121}$ mode is very substantially reduced by the use of the gasket. The test data of the Table also shows that the $TE_{011}$ is desirably increased. Thus, the obvious effect of the use of the gasket is to both reduce the Q of the unwanted modes and to increase the Q of the desired modes. In the tests, gaskets were used in both the so-called 'fixed' or $TE_{121}$ choke end and the 'tuned' end of plunger 18. The manner in which the gasket is used at the 'tuned' end is shown in FIG. 1. The test data, however, is predominantly affected by the $TE_{121}$ gasket at the 'fixed' end. Some benefit is derived from its use at the 'tuned' end and such a use is recommended. The invention, nevertheless, is primarily concerned with the $TE_{121}$ choke and the use of the gasket to render it effective.

Obviously many modifications and variations of the present invention are possible in the light of the above teachings. It is therefore to be understood that within the scope of the appended claims the invention may be practiced otherwise than as specifically described.

I claim:

1. Magnetron apparatus comprising:

a vacuum-sealed interaction cavity assembly including:

an axially-disposed cathode member, a anode member having an axially-extending medially slotted wall portion radially-spaced from the cathode member, a dielectric window member spaced radially from and surrounding said anode wall portion, and a cavity-sealing metallic connector strip member extending between each axial end portion of the dielectric window member and the proximate axial end portion of the anode wall portion, said dielectric window member sealably covering each anode member slot and having an axial length considerably less than said anode member whereupon the requisite axial extent of at least one of the metallic strip members is of sufficient electrical length of substantially impede longitudinally flowing electrical current, and a resonant cavity assembly formed for removably receiving said interaction cavity assembly, said resonant cavity assembly including:

axially-spaced end walls defining the axial extent of the cavity, one of the end walls being adjustable for tuning purposes and the other being relatively fixed whereby the cavity has an adjustable tuning end and a fixed end, said fixed end further having an axially-extending side wall spaced radially from said anode wall portion for providing an axially-extending choke cavity having an entrance opening from said resonant cavity, and said magnetron apparatus further including:

a lossy-material choke absorber member in said choke cavity for receiving and suppressing resonant cavity current modes coupled into the choke cavity through said entrance, said one metallic connector strip member extending axially through said choke cavity whereby said cavity-coupled current modes tend to flow longitudinally through it, and an electrically-conductive flexible gasket member disposed in close proximity to said choke cavity entrance between and in electrical contact with said connector strip and said anode wall portion whereby said modes present in said resonant cavity and applied to said strip member at said choke cavity entrance are shorted through said gasket member, said shorting removing said strip member impedance and permitting the desired mode suppression by said choke cavity and its absorber member.

2. The apparatus of claim 1 wherein said anode and dielectric window member are cylindrical co-axial shell-like members spaced radially one from the other.

3. The apparatus of claim 2 wherein said gasket is in the form of a ring-shaped knitted metal material having sufficient flexibility to safely absorb thermal expansion of said anode member relative to said dielectric member while maintaining said radial spacing between the members.

4. The apparatus of claim 2 further including:

a second flexible gasket member electrically-connecting said tuned-end strip member to the anode member, said second gasket maintaining said radial spacing between said anode and dielectric window members.

5. The apparatus of claim 4 wherein said second gasket is in the form of a ring-shaped knitted metal material.

6. The apparatus of claim 5 wherein said metallic strip members are formed of kovar.

* * * * *